United States Patent [19]

Burton

[11] 4,293,285

[45] Oct. 6, 1981

[54] PUMP

[75] Inventor: John D. Burton, Andover, England

[73] Assignee: William R. Selwood Limited, Hampshire, England

[21] Appl. No.: 90,157

[22] Filed: Oct. 31, 1979

[30] Foreign Application Priority Data

Oct. 31, 1978 [GB] United Kingdom ..... 42685/78

[51] Int. Cl.[3] ..... F04F 7/02

[52] U.S. Cl. ..... 417/240

[58] Field of Search ..... 417/240, 241, 53

[56] References Cited

U.S. PATENT DOCUMENTS

| | | | |
|---|---|---|---|
| 1,047,489 | 12/1912 | Beau | 417/240 |
| 1,941,593 | 1/1934 | Billoca | 417/240 |
| 2,232,678 | 2/1941 | Dickinson | 417/240 |
| 2,572,977 | 10/1951 | Bodine | 417/241 |
| 3,307,492 | 3/1967 | Selwood et al. | 417/480 |
| 4,097,203 | 1/1978 | Selwood et al. | 417/480 |

FOREIGN PATENT DOCUMENTS

| | | | |
|---|---|---|---|
| 1111153 | 4/1968 | United Kingdom | 417/480 |
| 1219762 | 1/1971 | United Kingdom | 417/480 |
| 1413866 | 11/1975 | United Kingdom | 91/499 |

OTHER PUBLICATIONS

Simple Novel Pumps by K. Jenson, Publication Date Jun. 1976.

*Primary Examiner*—William L. Freeh

*Attorney, Agent, or Firm*—Merriam, Marshall & Bicknell

[57] ABSTRACT

A pump for raising liquids through a height exceeding the barometric height has adjacent to an outlet of the pump a pumping chamber whereof one end is defined by a reciprocable center portion and a rubber annulus which is in non-sliding engagement with the center portion and with a peripheral wall of the chamber. Openings in the center portion are normally closed by a flap valve. The valve is held closed whenever the center portion is being moved in a direction to reduce the volume of the pumping chamber. Adjacent to an inlet to the pump, there is a chamber having a wall portion formed by an elastomeric sleeve which can store potential energy. Contraction of the sleeve is limited by a perforate metal support.

4 Claims, 1 Drawing Figure

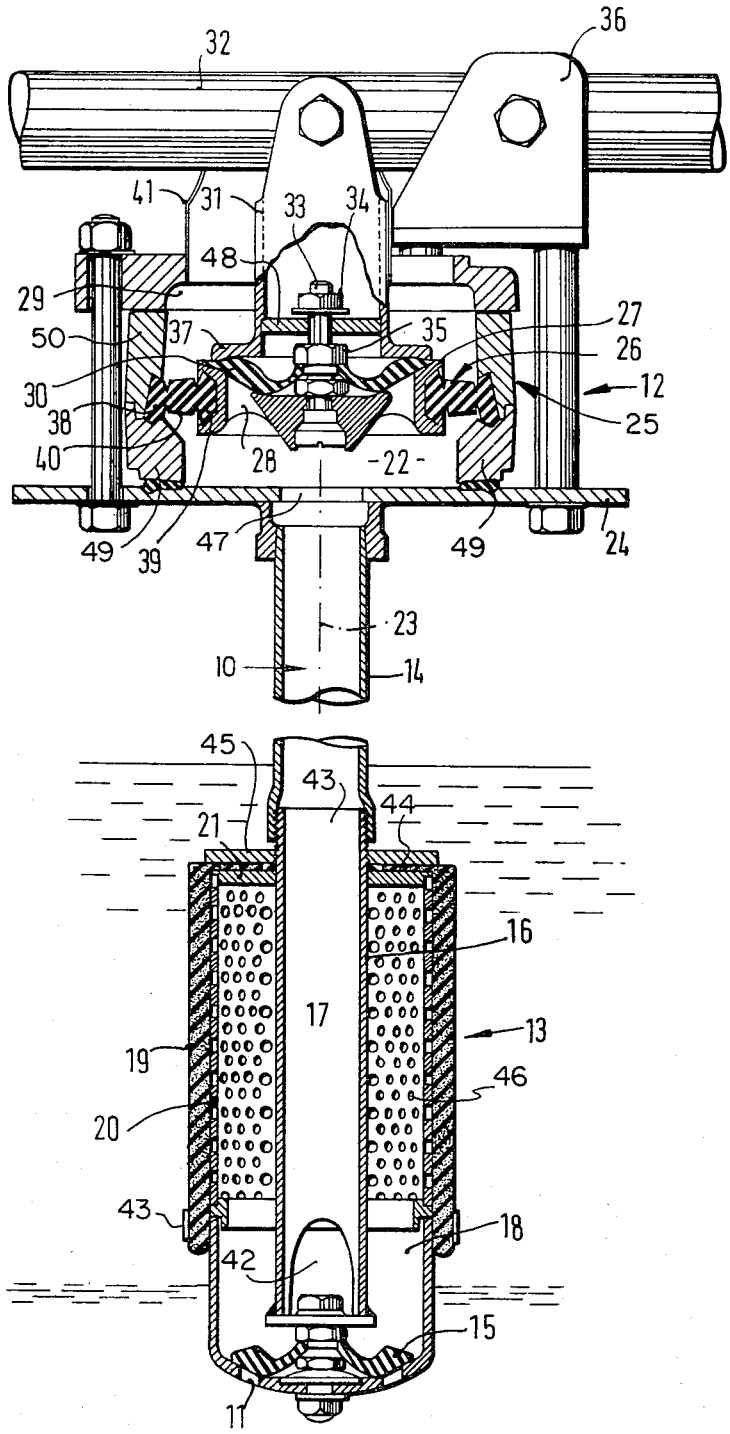
32
36
41
31
33
34
48
29
27
50
37
35
26
30
12
38
25
40
28
-22-
49
39
47
49
24
23
10
14
45
43
21
44
16
17
13
19
46
20
43
18
42
15
11

PUMP

FIELD OF THE INVENTION

This invention relates to a pump comprising a duct having an inlet at a lower position and an outlet at a higher position, an inlet valve at the inlet, which valve opens when the pressure in the duct adjacent to the inlet is below the pressure outside the duct adjacent to the inlet, storage means for storing potential energy which can be applied to liquid in the duct as kinetic energy and pressurising means for causing cyclic changes of pressure in a liquid in the duct. The invention also relates to improved storage means and pressurising means for use in a pump of the kind referred to.

BACKGROUND OF THE INVENTION

Pumps of the kind referred to can be used for raising liquids through a height exceeding the barometric height. During that part of the cycle of the pressurising means in which the pressure in the duct is increasing, energy is transferred from the pressurising means to the storage means by the downward movement of liquid in a direction from the pressurising means towards the storage means. During that part of the cycle in which the pressure in the duct is decreasing, the potential energy in the storage means is imparted to the liquid as kinetic energy and, since the inlet valve remains closed whilst the pressure in the duct adjacent to the inlet exceeds the outside pressure, the liquid moves owing to its kinetic energy in a direction away from the inlet, that is upwardly. Liquid is thereby caused to flow through the outlet of the duct. Whilst the liquid is flowing through the outlet, the pressure within the duct adjacent to the inlet eventually falls to a sufficiently low value for the inlet valve to open, thereby allowing further liquid to be admitted to the duct.

SUMMARY OF THE INVENTION

According to a first aspect of the invention, the pressurising means of a pump of the kind referred to comprises a pumping chamber defined, at least in part, by a lateral wall, an annulus of elastomeric material having its outer periphery in non-sliding contact with the lateral wall and a centre portion in non-sliding contact with the inner periphery of the annulus, wherein the lateral wall and the centre portion are formed of relatively rigid material and are reciprocable relative to each other to vary the volume of pumping chamber, the annulus is stressed in compression between the lateral wall and the centre portion, there is provided an outlet valve for controlling flow of liquid through the outlet and the pressurising means further comprises means for maintaining the outlet valve closed while the pressure in the pumping chamber is increasing.

Pressurising means in accordance with the invention is particularly well adapted to withstand high internal pressures. In an efficient pump of the kind referred to, the pressure in the pressurising means may rise, during operation, to a value in the range two to three times the pressure head exerted by a static column of the liquid being pumped having a height equal to the height of the outlet above the inlet.

The annulus of elastomeric material is capable of providing a completely fluid-tight seal between the centre portion and the lateral wall of the pumping chamber and the effectiveness of this seal is not reduced by the presence of abrasive particles in the liquid being pumped. Subjection of the annulus to compressive stress enables the annulus to have a long service life although it has to tolerate relative reciprocation of the centre portion and lateral wall and also enables high pressures to be established in the pumping chamber. It will be understood that, if the chamber is defined in part by a member which yields easily and is thereby adapted to accommodate relative movement of other parts defining the chamber, high pressures could not be established in the chamber.

In the preferred arrangement, the annulus and the centre portion collectively define one end of the pumping chamber and are adapted to prevent escape of fluid from the pumping chamber at said one end whilst the centre portion is being moved relative to the lateral wall in a direction to reduce the volume of the chamber but to permit such escape when the centre portion is being moved in the opposite direction.

There is preferably associated with the pumping chamber an outlet valve and valve control means adapted to hold the outlet valve closed during relative movement of the centre portion and lateral wall in a direction to decrease the volume of the pumping chamber and to allow the outlet valve to open during relative movement in the opposite direction. The outlet valve is preferably a non-return valve adapted to open only when the pressure in the pumping chamber exceeds the pressure outside the pumping chamber at the downstream side of the outlet valve.

There is also provided according to the invention an inlet device for a pump of the kind referred to, the device comprising an elastomeric wall portion which defines, at least in part, a chamber having an inlet at one end and an outlet at an opposite end, a relatively rigid support for the elastomeric wall portion and a non-return valve for admitting liquid to the chamber through the inlet, the support being arranged to limit deflection of the elastomeric wall portion in a direction inwardly of the chamber.

When the pressure at the inside of the elastomeric wall portion exceeds the pressure outside by a predetermined value, the wall portion deflects to increase the volume of the chamber and thereby stores potential energy. The pressure inside the chamber, exceeding the pressure outside, maintains the inlet valve closed. When the pressure in the chamber falls, the elastomeric wall portion moves in a direction to reduce the volume of the chamber and so cause liquid to flow from the chamber along the duct towards the outlet of the duct. Movement of the elastomeric wall portion in this direction ceases abruptly when the wall portion reaches the limit determined by the support. Owing to the kinetic energy of the liquid flowing from the chamber, the pressure in the chamber falls abruptly and the inlet valve opens. It will be understood that if movement of the elastomeric wall portion in a direction to reduce the volume of the chamber was not so limited, the volume available to be occupied by liquid entering through the inlet valve would be correspondingly smaller.

The arrangement is preferably such that the elastomeric wall portion is stressed in tension when supported by the support, this arrangement enables the elastomeric wall portion to store a relatively large amount of potential energy without either the wall portion itself or the associated chamber occupying a large volume.

BRIEF DESCRIPTION OF THE DRAWING

One example of a pump embodying each aspect of the invention will now be described with reference to the accompanying drawing which shows a pump mainly in cross-section in a vertical plane.

DESCRIPTION OF THE PREFERRED EMBODIMENT

The pump comprises a duct 10 having a lower end at which there is an inlet opening 11 and an upper end at which there is an outlet 41 having an outlet opening (not shown). Immediately below the outlet of the duct, there is a pressurising means 12 for causing cyclic changes of pressure in liquid in the duct. Above and adjacent to the inlet opening 11 there is a storage means 13 for storing energy which can be applied to liquid in the duct as kinetic energy. A portion of the duct extending between the pressurising means and the storage means is formed by a vertical pipe 14 which may have a length in the range 10 to 30 meters.

The storage means 13 constitutes a part of an inlet device which is secured to the lower end of the pipe 14. The inlet device defines the inlet opening 11 and further includes an inlet valve 15 for controlling the flow of liquid through the inlet opening. The inlet valve is a non-return flap valve arranged normally to close the opening 11 and to open only when the pressure outside the device exceeds the pressure inside the device.

The inlet device defines a chamber which is divided by a vertical tube 16 into inner and outer chambers 17 and 18 which are permanently in communication with each other through openings 42 formed in the tube 16 near to the lower end thereof. The tube 16 is secured at its upper end in fluid-tight relation to the pipe 14 and an upper end portion 43 of the inner chamber 17 constitutes an outlet of the device.

A part of the radially outer boundary of the outer chamber 18 is defined by an elastomeric wall portion in the form of a sleeve 19. The sleeve embraces a tubular support 20 which is rigidly connected at its upper and lower ends with the tube 16 in a fluid-tight manner. Opposite end portions of the sleeve are maintained in fluid-tight relation with the support 20. In the particular example illustrated, a lower end portion of the sleeve 19 is clamped to the support 20 by a metal band 43 and an upper end of the sleeve has an integral, radially inwardly projecting flange 44. This flange is maintained in fluid-tight engagement with an upwardly facing surface of a plate 21 which connects the support 20 with the tube 16. A clamping ring 45 is screwed onto the upper end portion of the tube 16 to clamp the flange 44 to the plate 21. In that part of the support 20 which is covered by the rubber sleeve 19, there is formed a large number of apertures 46, the apertures being distributed completely around the circumference of the support 20 and each having an area which is a plurality of times less than the area of the cross-section of the duct defined by the pipe 14 and tube 16.

The rubber sleeve 19 is stressed in tension, even when resting on the support 20. The unstressed internal diameter of the sleeve 19 is significantly smaller than the outside diameter of the support 20. The support is formed of metal and prevents deflection of the rubber sleeve from the position illustrated in the drawing in the inward direction, even when the pressure in the chamber 18 falls below the external pressure during operation of the pump.

The pressurising means 12 comprises a pumping chamber 22 into which the pipe 14 leads. The pumping chamber is of cylindrical shape as viewed in plan and has a common axis 23 with the pipe 14. A lower boundary of the pumping chamber is defined by a plate 24 to which an upper end portion of the pipe 14 is secured. The plate has an inlet opening 47 aligned with the interior of the pipe. A peripheral boundary of the pumping chamber 22 is defined by a lateral wall 25 which projects upwardly from the plate 24. An upper boundary of the pumping chamber is defined by an annulus 26 of elastomeric material having its outer periphery in non-sliding contact with the lateral wall 25 and a centre portion 27 in non-sliding contact with the inner periphery of the annulus. In the centre portion 27, there are formed several apertures 28 through which the pumping chamber 22 can communicate with an upper chamber 29 which, in turn, communicates with the outlet 41 of the duct 10. The centre portion 27 and the lateral wall 25 are formed of metal and the centre portion 27 can undergo limited reciprocation along the axis 23 relative to the lateral wall 25. Such reciprocation is accommodated by flexing of the annulus 26.

On the centre portion 27, there is provided an outlet valve 30 for controlling the flow of liquid through the apertures 28. The valve 30 is a non-return flap valve formed of elastomeric material and arranged normally to close the apertures 28 and to maintain them closed when the pressure in the upper chamber 29 exceeds the pressure in the pumping chamber 22.

There is also associated with the centre portion 27 and the outlet valve 30, valve control means which is adapted to hold the outlet valve 30 closed during movement of the centre portion 27 in a direction to decrease the volume of the pumping chamber 22, that is in the downward direction. The valve control means includes a connecting member 31 which is pivotally connected with a handle 32 and is connected with the centre portion 27 by means providing some lost motion and thereby allowing limited relative movement of the centre portion 27 and connecting member 31 along the axis 23. As can be seen from the drawing, a screw-threaded pin 33 extends upwardly from the centre portion 27 through an aperture in a horizontal element 48 of the connecting member 31. The pin 33 is a free sliding fit in this aperture and the horizontal element 48 of the connecting member 31 is trapped between two nuts 34 and 35 on the pin 33. The spacing between the nuts is somewhat greater than the thickness of the horizontal element 48 to provide freedom for the required degree of relative vertical movement. The lower nut 35 is also used to secure the outlet valve 30 on the centre portion 27.

The handle 32 is in the form of a lever which pivots in a vertical plane about a fulcrum defined by a bracket 36. The range of angular movement of the handle 32 is limited by stops (not shown) to a value such that the annulus 26 cannot be subjected to excessive stress.

The connecting member 31 includes a radially outwardly projecting flange 37 which lies immediately above the outlet valve 30. When the connecting member 31 is urged downwardly towards the centre portion 27, the flange 37 bears on the outlet valve 30 and at least a part of the downwardly directed force applied by the connecting member 31 to the centre portion 27 is transmitted through the outlet valve 30. The outlet valve 30 is therefore held closed. When the connecting member 31 is raised away from the centre portion 27, the flange 37 permits the outlet valve to open if the pressure in the pumping chamber 22 exceeds the pressure in the upper chamber 29.

An outer margin 38 of the annulus 26 lies in a groove formed in the lateral wall 25. The upper and lower boundaries of this groove are undercut and the outer margin has a similar cross-section. For convenience of assembly, the lateral wall is formed in upper and lower parts 50 and 49 between which the outer margin 38 is trapped. The inner margin 39 of the annulus 26 lies in a groove formed in the centre portion 27. The upper and lower boundaries of this groove diverge from the base of the groove and then converge towards each other adjacent to the mouth of the groove. The inner margin 39 has a cross-section similar to that of the groove. Between the centre portion 27 and the lateral wall 25, lies a medial portion 40 of the annulus. This medial portion is integrally connected with the inner and outer margins by respective necks which have smaller thicknesses than the margins 38 and 39 and the medial portion 40. The surface of the medial portion 40 which is presented towards the pumping chamber 22 bulges downwardly and the opposite surfaces of the medial portion 40 bulges upwardly. In its unstressed condition, the annulus 26 has a radial width which exceeds the separation between the respective bases of the grooves in which the outer and inner margins 38 and 39 are received. Accordingly, when the annulus 26 is assembled with the centre portion 27 and the lateral wall 25, it is subjected to compressive stress. Typically, the radial width of the annulus 26 is reduced by between 10 and 20%. The outer and inner margins 38 and 39 are additionally subjected to some degree of axial compression, since the margins of the unstressed annulus 26 are somewhat larger than the grooves in which they are received.

The pump is operated by moving the handle 32 upwardly and downwardly. During downward movement of the handle, the outlet valve 30 is held closed and the volume of the pumping chamber 22 is reduced by downward movement of the centre portion 27. This causes the pressure in the duct 10 to rise and the rubber sleeve 19 is stretched away from the support 20, thereby storing potential energy. When the centre portion 27 has reached the bottom of its stroke and commences to move upwardly, the pressure in the duct 10 is reduced and the sleeve 19 contracts to reduce the volume of the outer chamber 18 and cause water to flow up the pipe 14. The upward flow continues after the sleeve 19 has contracted onto the support 20 and the pressure in the outer chamber 18 then falls to a value below that outside the inlet valve 15. The inlet valve therefore opens and liquid enters the duct 10. During the upward stroke of the centre portion 27, the outlet valve 30 is free to open. As the upward velocity of the centre portion decreases, liquid flows throuh the apertures 28 to the outlet of the duct 10.

I claim:

1. In or for a pump comprising a duct having an inlet at a lower position and an outlet at a higher position, an inlet valve at the inlet, which valve opens when the pressure in the duct adjacent to the inlet is below the pressure outside the duct adjacent to the inlet, storage means for storing potential energy which can be applied to liquid in the duct as kinetic energy and pressurising means for causing cyclic changes in pressure in a liquid in the duct, improved pressurising means comprising a pumping chamber defined, at least in part, by a lateral wall, an annulus of elastomeric material having its outer periphery in non-sliding contact with the lateral wall and a centre portion in non-sliding contact with the inner periphery of the annulus, wherein the lateral wall and the centre portion are formed of relatively rigid material and are reciprocable relative to each other to vary the volume of the pumping chamber, wherein the annulus is stressed in compression between the lateral wall and the centre portion, wherein an outlet valve is provided for controlling the flow of liquid through the outlet which outlet valve is a non-return valve adapted to open only when the pressure in the pumping chamber exceeds the pressure in the outlet at the downstream side of the outlet valve and wherein there is provided in the centre portion an aperture through which liquid can leave the pumping chamber when the outlet valve is open, and the outlet valve is operatively associated with the centre portion for controlling the flow of liquid through the aperture therein, the pressuring means further comprising closing means for maintaining the outlet valve closed while the pressure in the pumping chamber is increasing, wherein said closing means is connected with the centre poriton for limited movement relative thereto and is adapted for transmitting to the centre portion driving forces which cause relative reciprocation of the centre portion and the lateral wall.

2. Pressurising means according to claim 1 further including a lever and wherein said means for maintaining the oulet valve closed comprises a connecting member pivotally connected with the lever and connected also with the centre portion by means permitting limited relative movement of the connecting member and centre portion in a direction along an axis of the pumping chamber, the outlet valve being a flap valve secured on the centre portion to lie between the centre portion and the connecting member and the connecting member being engageble with the flap valve to maintain same in a closed position with respect to the opening in the centre portion.

3. In or for a pump comprising a duct having an inlet at a lower position and an outlet at a higher position, an inlet valve at the inlet, which valve opens when the pressure in the duct adjacent to the inlet is below the pressure outside the duct adjacent to the inlet, storage means for storing energy which can be applied to liquid in the duct as kinetic energy and pressurising means for causing cyclic changes of pressure in a liquid in the duct, improved storage means in the form of a device comprising an elastomeric wall portion which defines, at least in part, a chamber, the chamber having an inlet at one end and an outlet at an opposite and, a non-return valve for controlling the flow of liquid through the inlet and the device further comprising a relatively rigid support for the elastomeric wall portion, the support being arranged for limiting deflection of the elastomeric wall portion in a direction inwardly of the chamber wherein the external dimensions of the support exceed the internal dimensions of the unstressed elastomeric wall portion so that the elastomeric wall portion is stressed in tension when supported by the support.

4. Storage means according to claim 3 wherein the elastomeric wall portion is in the form of a sleeve which embraces the support.

* * * * *